US005967823A

United States Patent [19]

Tsui

[11] Patent Number: 5,967,823

[45] Date of Patent: Oct. 19, 1999

[54] STRUCTURE FOR A BELT LIGHT AND AN EXTENSION DEVICE THEREFOR

[76] Inventor: Pui-Hing Tsui, Unit 1024, 10/Fl. Star House, No. 3, Salisbury Road, Tsimshatsui, Kowloon, The Hong Kong Special Administrative Region of the People's Republic of China

[21] Appl. No.: 08/854,409

[22] Filed: May 12, 1997

[30] Foreign Application Priority Data

Sep. 3, 1996 [CN] China ..... 96222554

[51] Int. Cl.[6] ..... H01R 13/52

[52] U.S. Cl. ..... 439/280; 439/427; 439/415; 439/419

[58] Field of Search ..... 439/280, 277, 439/415, 414, 419, 427

[56] References Cited

U.S. PATENT DOCUMENTS

| | | | |
|---|---|---|---|
| 4,091,233 | 5/1978 | Berman | 439/427 |
| 5,121,310 | 6/1992 | Ahroni | 439/419 |
| 5,503,568 | 4/1996 | Pryce | 439/427 |
| 5,643,006 | 7/1997 | Wang et al. | 439/419 |
| 5,681,179 | 10/1997 | Lane | 439/427 |
| 5,755,589 | 5/1998 | Koch | 439/427 |

*Primary Examiner*—Neil Abrams
*Assistant Examiner*—T C Patel
*Attorney, Agent, or Firm*—Merchant & Gould P.C.

[57] ABSTRACT

An improved structure of belt light includes a plurality of bulb holders and an electric belt. Each of the bulb holders has a base and a bulb socket mounted on the base with the electric belt extending through the base of the bulb holders, characterized in that: the base of each of the bulb holders is integrally formed with the electric belt and each of the bulb sockets has a watertight rim which is made of a resilient insulation material and which is provided along a top circumference thereof so that when a bulb is received within the bulb socket, the lower side of the glass portion of the bulb is in sealing and resilient contact with the water tight rim. The present invention further provides an extension device for the belt light, which includes a conductive pin device, an insulation housing and a retainer. The conductive pin device is disposed in a first channel formed within the insulation housing. When the retainer is electrically connected to the conductive pin device, the catches disposed on opposite sides of the retainer engage and secure to the grooves formed on two opposite sides of the insulation housing to constitute a releasable engagement.

14 Claims, 9 Drawing Sheets

STRUCTURE FOR A BELT LIGHT AND AN EXTENSION DEVICE THEREFOR

FIELD OF THE INVENTION

The present invention relates to a decorative light structure and in particular to the improved structure of a belt light and an extension device for the belt light.

DESCRIPTION OF THE RELATED ART

Conventional belt lights have been widely used in illuminative decoration purpose for years, such as celebration, Christmas decoration, restaurant and pubs. However, the conventional belt light has the problem of water leakage which may cause a short circuit so that the conventional belt light has never been issued a UL certificate. Further, due to the disadvantages in structure, the conventional belt light is subject to limitations in length and configuration. Referring to FIG. 1 which shows a cross sectional view of a conventional belt light 1, such disadvantages of the conventional belt light will be described as follows:

(1) In the design of the conventional belt light 1, in order to obtain a secure engagement between the metal helical ground electrode 3 of the bulb 2 and the bulb socket 4, the bulb socket 4 is usually made of a rigid plastic so as to prevent the bulb 2 from being detached from the socket 4 due to a large external force acting thereon. Due to such a structure, together with the fact that the glass portion of each bulb 2 may not be manufactured to be exactly the same, humidity coming from the outside may get into the socket 4 through the junction between the metal helical ground electrode 3 and the socket 4 to result in a short circuit and affect the service life of the belt light 1.

(2) The electric belt 5 of the conventional belt light 1 is first extended through the base 6 of the bulb socket 4 and fixed thereto by means of ultra sonic technique or adhesive. Such a fixation may not be able to completely seal the electric belt 5 and the base 6 together. And, if it is exposed to severe environment for a long term, such as intensity sun light and rain, the sealing therebetween may be deteriorated such that the external humidity can further leak into the socket 4 to cause a short circuit and affect the service life.

(3) In the conventional belt light 1, since there is no extension device or joint device, it is not possible to vary the length and configuration to comply with the change in environment and the desired condition for illumination, which may cause significant inconvenience in use of the belt light.

In view of the above disadvantages, it is an urgent topic for people in this field to provide one or more measures to overcome the above disadvantages and obtain an improved structure of belt light as well as an extension device therefor, which has a low cost in manufacturing, assembling and maintenance. Thus, the present invention provides a creative and novel improved structure of belt light and an extension device therefor which are disclosed in the following detailed description.

SUMMARY OF THE INVENTION

A primary object of the present invention is to provide an improved structure of belt light which prevents humidity from leaking therein by means of a design of integral structure of the electric belt and the base of the bulb socket, thereby eliminating any damage and short circuit and thus increasing the service life of the belt light.

A secondary object of the present invention is to provide an improved structure of belt light which prevents humidity from leaking therein through the gap between the bulb socket and the bulb by the provision of a double layered structure of the bulb socket and a watertight rim, thereby eliminating damage and short circuit, increasing the service life thereof, and also providing a sufficient connection strength between the bulb and the socket so as to prevent the bulb from being separated from the socket by external forces.

Another object of the present invention is to provide an extension device for the belt light which allows a plurality of belt lights to be connected together or detached from each other based on the desired length by the design of a releasable engagement between catches and grooves.

A further object of the present invention is to provide joint devices for belt lights having various shapes, which allows a number of belt lights to be arranged in accordance with the spatial limitation and arranging requirement to provide different illumination.

DESCRIPTION OF THE REFERENCE NUMERALS

Figure 1:
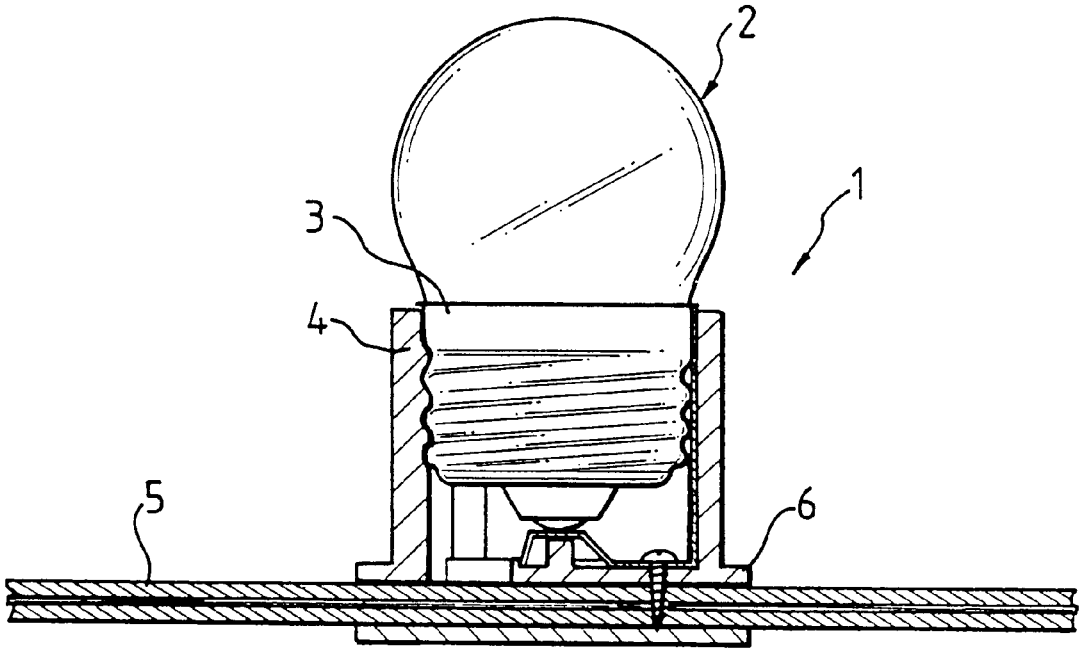
FIG. 1 (PRIOR ART)
FIG. 1 is a cross sectional view showing the structure of a conventional belt light.

(1) conventional belt light
(2) bulb
(3) metal helical ground electrode
(4) bulb socket
(5) electric belt
(6) base
(10) belt light of the present invention
(20) bulb holder (21) base
(22) bulb socket
(23) conductive selection holes
(24) live electrode copper strip
(25) ground electrode copper strip
(26) metal screws
(27) through hole
(28) through hole
(29) holes
(30) electric belt
(31) insulation enclosure
(32) electric wires
(40) bulb
(41) metal helical ground electrode
(42) live electrode contact
(43) glass portion
(50) extension device
(51) conductive pin device
(52) insulation housing
(53) retainer
(60) L shaped joint device
(61) receiving slots
(62) L shaped pin receiving device
(70) T shaped joint device
(71) receiving slots
(72) T shaped pin receiving device
(80) cross joint device
(81) receiving slots
(82) cross pin receiving device
(90) end cap
(221) watertight rim
(222) outer jacket
(511) first rigid pins
(512) carrier
(513) second rigid pins
(521) first channel
(522) grooves
(531) connector
(532) insulation casing
(533) third channel
(534) end rim
(535) flange
(536) front portion
(537) rear portion
(538) catches
(539) third rigid pins
(540) second channel
(541) pin receiving tubes
(542) third rigid pins

DETAILED DESCRIPTION OF THE PREFERRED EMBODIMENT

Figure 2:
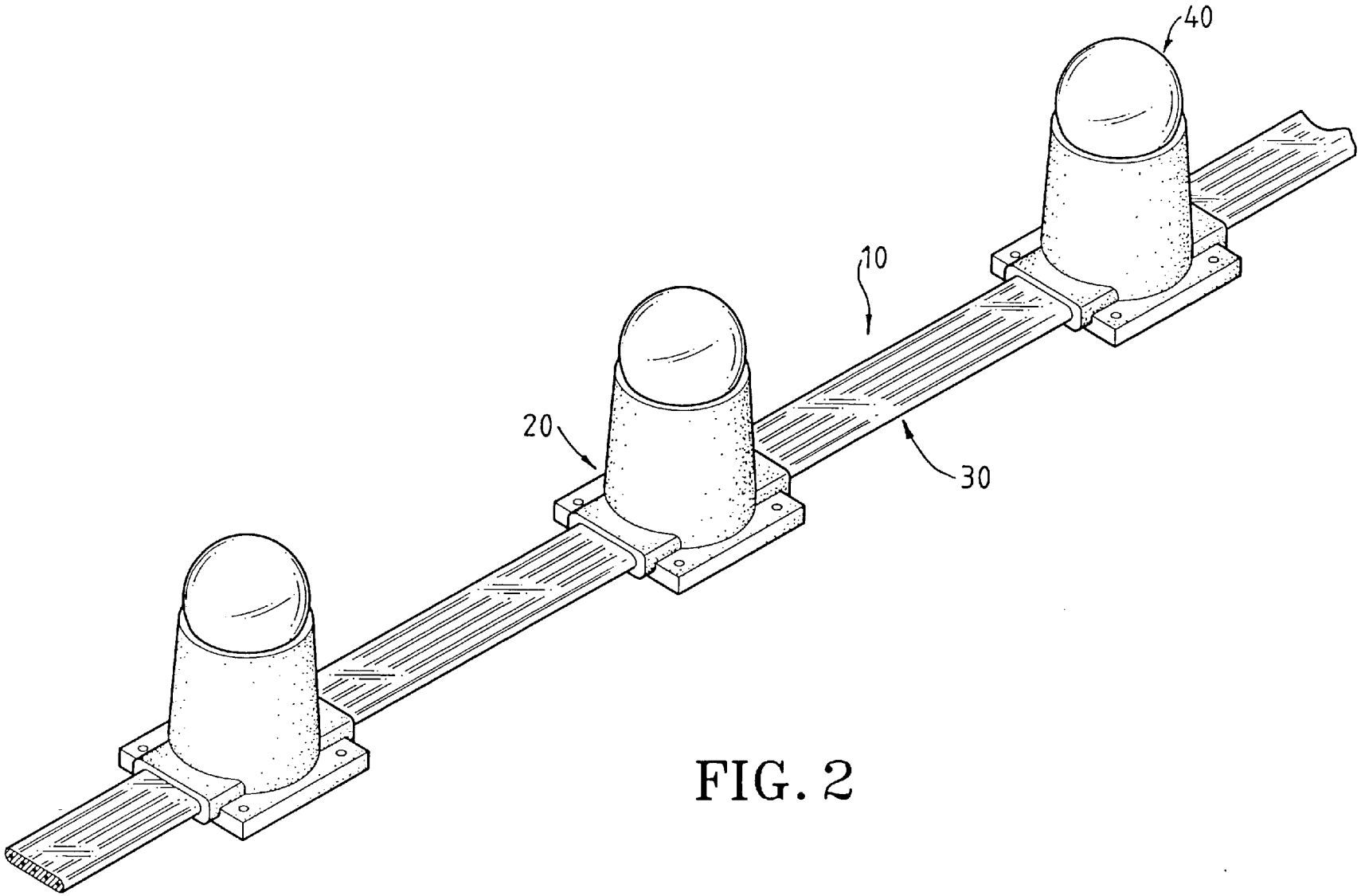
FIG. 2 is a perspective view of the improved structure of belt light in accordance with the present invention.
Figure 3:
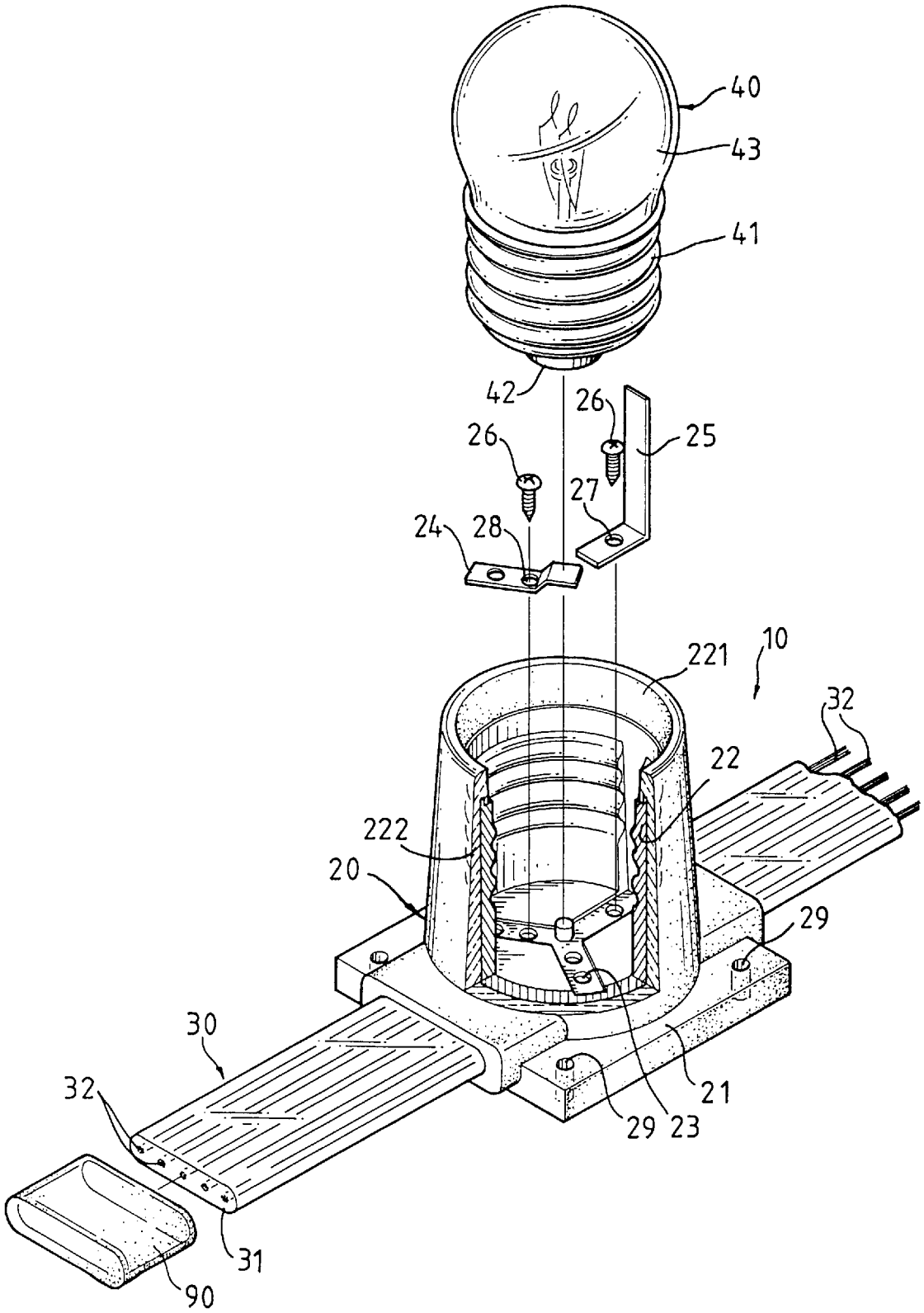
FIG. 3 is an exploded perspective view, partially broken, showing the improved structure of the belt light in accordance with the present invention.
Figure 4:
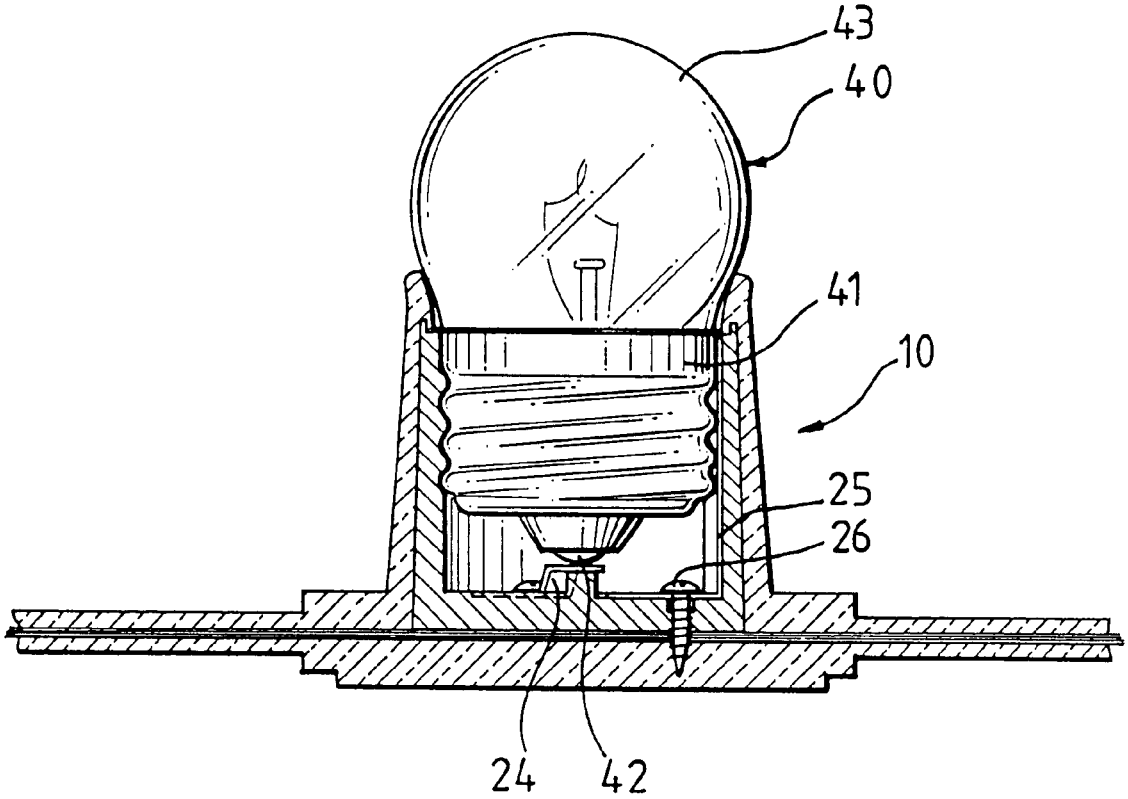
FIG. 4 is a cross sectional view showing the improved structure of the belt light in accordance with the present invention.
Figure 5A:
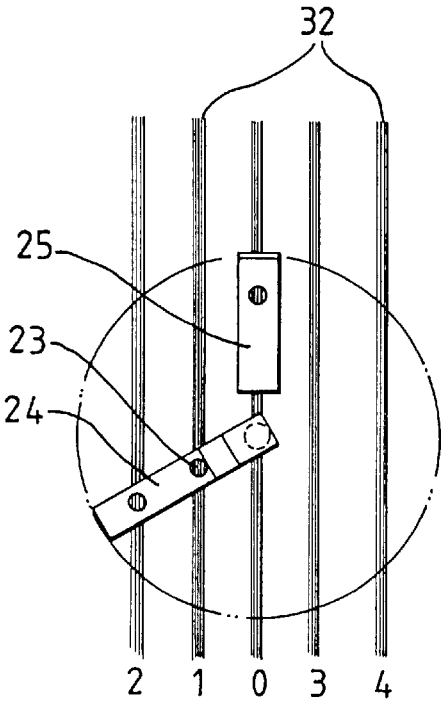
FIG. 5*a* is schematic view showing the electrical connection between the electric wires and copper strips of the improved structure of belt light in accordance with the present invention.
Figure 5B:
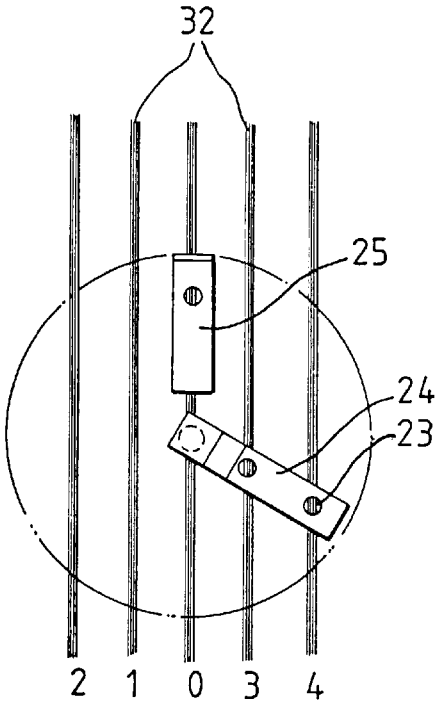
FIG. 5*b* is another schematic view showing the electrical connection of the improved structure of belt light in accordance with the present invention.

FIG. 2 is a perspective view showing an improved structure of a belt light 10 in accordance with the present invention. Also referring to FIGS. 3 and 4, the improved structure of the belt light 10 comprises a plurality of bulb holders 20 and an electric belt 30. Each of the bulb holders 20 which are made of a rigid insulation material comprises a base 21 and a cylindrical bulb socket 22 fixed on the base 21. The electric belt 30 which extends through the base 21 of the bulb holder 20 comprises a solid insulation enclosure 31 and a plurality of electric wires 32 which are parallel to each other and enclosed within the enclosure 31. The socket 22 forms on the bottom thereof a plurality of conductive selection holes 23, independently extending through the bottom of the socket 22 to the electric wires 32 received within the insulation enclosure 31 of the electric belt 30. The electricity conduction and the operation of the belt light 10 in accordance with the present invention are described with further reference to FIGS. 5*a* and 5*b*, wherein each of the belt lights 10 comprises five electric wires 32 and four bulb holders 20. To allow the four bulb holders 20 to present alternate flashing effect, the sockets 22 are provided, on the bottom thereof, with a live electrode copper strip 24, an L shaped ground electrode copper strip 25 and two metal screws 26. The central one of the electric wires 32 is a common electric wire and is numbered "0" which is in electrical connection with a helical ground electrode 41 of the bulb 40, while the remaining four electric wires are respectively numbered "1", "2", "3" and "4". In one of the bulb holders 20, one of the metal screws 26 penetrates through a hole 27 formed on the L shaped ground electrode copper strip 25, and the conductive selection hole 23 to contact the "No. 0" common electric wire 32 so as to have the "No. 0" common electric wire 32 in electrical connection with the helical ground electrode 41 of the bulb 40. Thereafter, another one of the metal screws 26 penetrates through a hole 28 formed on the live electrode copper strip 24, and the conductive selection hole 23 corresponding to the "No. 1" electric wire 32 to contact the "No. 1" electric wire 32 so as to have the "No. 1" electric wire 32 in electrical connection with the live electrode contact 42 of the bulb 40. Similarly, by means of the penetration of the metal screws 26, the "No. 0" electric wire 32 and the "No. 2" electric wire 32 are in electrical connection with the helical ground electrode 41 and live electrode contact 42, respectively. Further, the "No. 0" electric wire 32 and "No. 3" electric wire 32 of the further next bulb holder 32 are made in electrical connection with the bulb 40, and the "No. 0" electric wire and "No. 4" electric wire 32 of the even further next bulb holder 32 are made in electrical connection with the bulb 40. As such, the bulbs 40 mounted within the four bulb holders 20 can present alternate flashing fashion.

The improved structure of the belt light 10 in accordance with the present invention is characterized in that the base 21 of each of the bulb holders 20 and the electric belt 30 are integrally formed and a watertight rim 221 made of a flexible insulation material is provided along a top circumference of each of the sockets 22 in such a manner that when the bulb 40 is screwed into the socket 22, the lower side of the glass portion 43 of the bulb 40 is in resilient and watertight contact with an inner side of the watertight rim 221. Preferably, each of the bulb holders 20 further comprises an outer jacket 222 made of the same material as the watertight rim 221 is integrally formed with and extends from the watertight rim 221 to surround the socket 22. More preferably, the outer jacket 222, the socket 22 and the base 21 of the bulb holder 20 are formed integrally. Such a particular design prevents humidity coming from the outside from leaking into the tiny space between the base 21 of the bulb holder 20 and the insulation enclosure 31 of the electric belt 30 or between the socket 22 and the helical ground electrode 41 of the bulb 40, and leaking in the electrical connection area of the helical ground electrode 41 of the bulb 40, the live electrode contact 42, copper strips 24 and 25 and the electric wires 32 that are located on the bottom of the socket 22 to cause a short circuit and thus affect the overall life of the belt light 10.

Figures 6A, 6B, 6C:
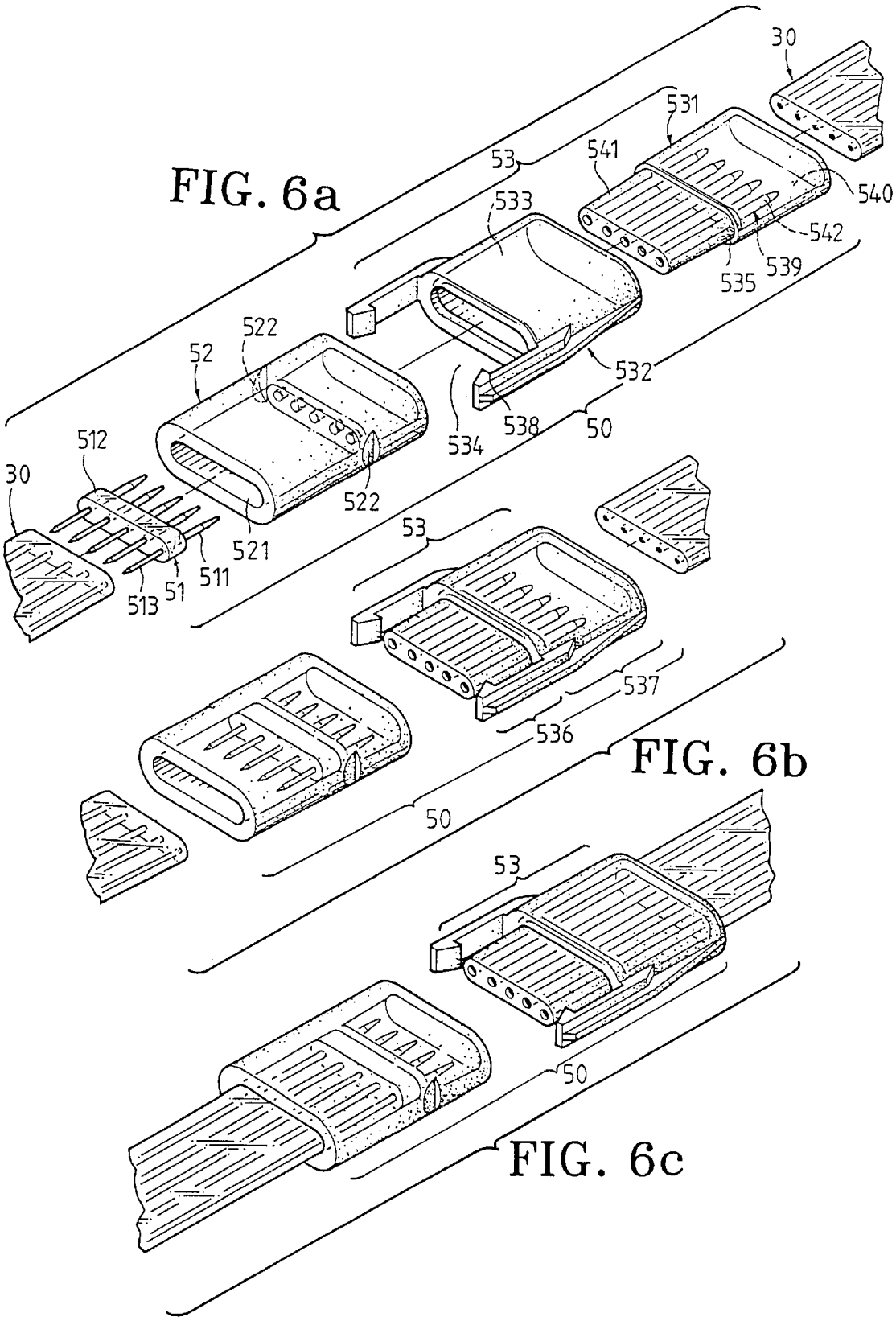
FIG. 6*a* is an exploded perspective view showing an extension device in accordance with the present invention.
FIGS. 6*b* and 6*c* are perspective views of partially assembled conditions of FIG. 6*a;*

Referring now to FIGS. 6*a*, 6*b* and 6*c*, the present invention also provides an extension device 50 mounted to an end of the electric belt 30 of the belt light 10 to electrically connect to an end of the electric belt 30 of another belt light 10 so as to provide a desired length of the electric belt. The extension device 50 comprises a conductive pin device 51 and an insulation housing 52. The conductive pin device 51 comprises five first rigid pins 511 which have sharpened ends pointing rearward and are secured within a carrier 512 to respectively correspond to the five electric wires, and five second rigid pins 513 which has sharpened ends pointing forward and are respectively and electrically connected to the first rigid pins 511. The insulation housing 52 comprises a first channel 521 extending therethrough in a front to rear direction. The conductive pin device 51 is received within a central section of the first channel 521. The two belt lights 10 to be connected are inserted into the insulation housing 52 through the front end and rear end of the housing 52 such that the second rigid pins 513 and the first rigid pins 511 of the conductive pin device 51 can respectively penetrate into the corresponding electric wires 32 along the lengthwise direction, thereby accomplishing the electric connection of the two belt lights 10. It is preferable to fill an adhesive in the first channel 521 to enhance the effect in sealing and water tightness.

To make the extension device 50 be releasable, the extension device 50 may further comprise a retainer 53. The retainer 53 is preferably comprised of a connector 531 and an insulation casing 532, wherein the insulation casing 532 comprises a third channel 533 extending therethrough in a front to rear direction. The third channel 533 has an end rim 534 provided at a front end thereof and the connector 531 has a flange 535 along the circumference at the central section thereof so that when the connector 531 is inserted into the insulation casing 532 through the rear side of the third channel 533, the flange 535 of the connector 531 abuts against the end rim 534 of the third channel 533, thereby constituting the retainer 53.

Referring to FIG. 6*b*, the retainer 53 comprises a front portion 536 and a rear portion 537, two catches 538 mounted to the opposite sides of the insulation casing 532 and extending forward, and five conductive terminals 539 corresponding to the electric wires 32. The front portion 536 is made of solid insulation material. The rear portion 537 comprises a second channel 540 extending in a front to rear direction. Each of the terminals 539 comprises a pin receiving tube 541 and a third rigid pin 542 electrically connected to rear side of the respective pin receiving tube 541 and having sharpened end pointing rearward. The five terminals 539 extend from the front edge of the front portion 536 into the second channel 540 to be secured within the retainer 53. (In fact they are fixed inside the connector 531.) The insulation housing 52 has a groove 522 provided at two opposite sides thereof. To enhance the overall strength so as to prevent the connector 531 from being separated from the insulation casing 532 and to provide excellent insulation effect, an adhesive may be filled into the third channel 533.

Referring to FIG. 6*c*, to electrically connect the two belt lights 10, it only needs to insert the electric belt 30 into the front side of the first channel 521 and the rear side of the second channel 540 to have the second rigid pins 513 and the third rigid pins 542 penetrate into respective electric wires 32 of the electric belt 30. The front portion 536 of the retainer 53 is then inserted into the rear side of the first channel 521 to have the first rigid pins 511 received within the pin receiving tubes 541 with the two catches 538 fastening in the two grooves 522, thereby forming a releasable catching engagement. To further enhance water tightness and the overall catching strength, an adhesive may be filled into the front end of the first channel 521 and the rear end of the second channel 540, and the front portion 536 of the retainer 53 may be formed with a resilient plastic and may be slightly tapering to provide a more perfect design.

Figure 7:
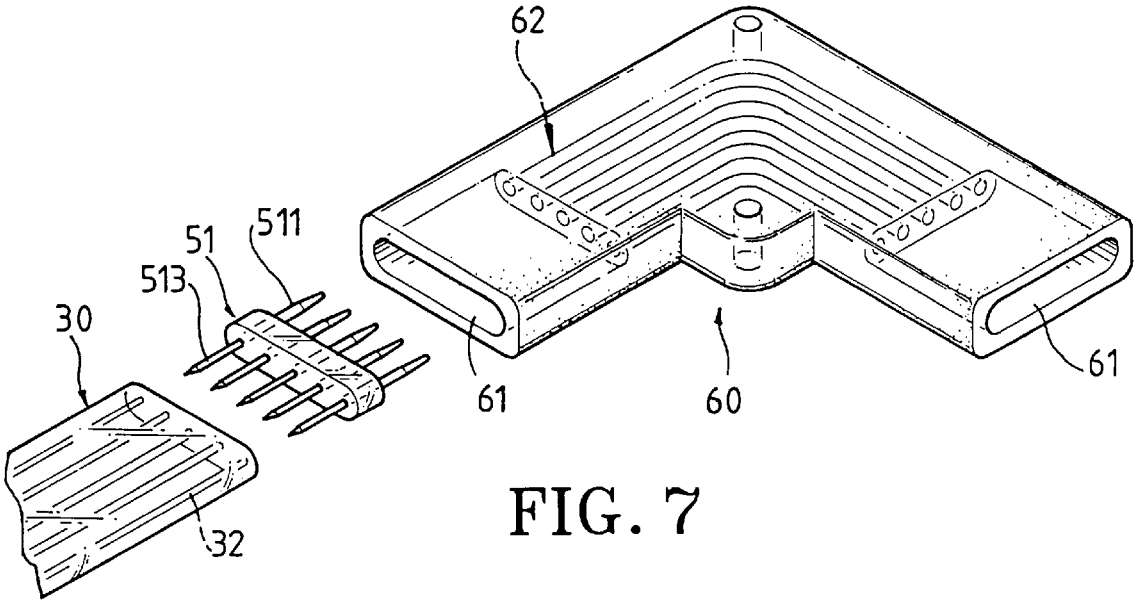
FIG. 7 is a perspective view showing an L shaped joint device in accordance with the present invention.
Figure 8:
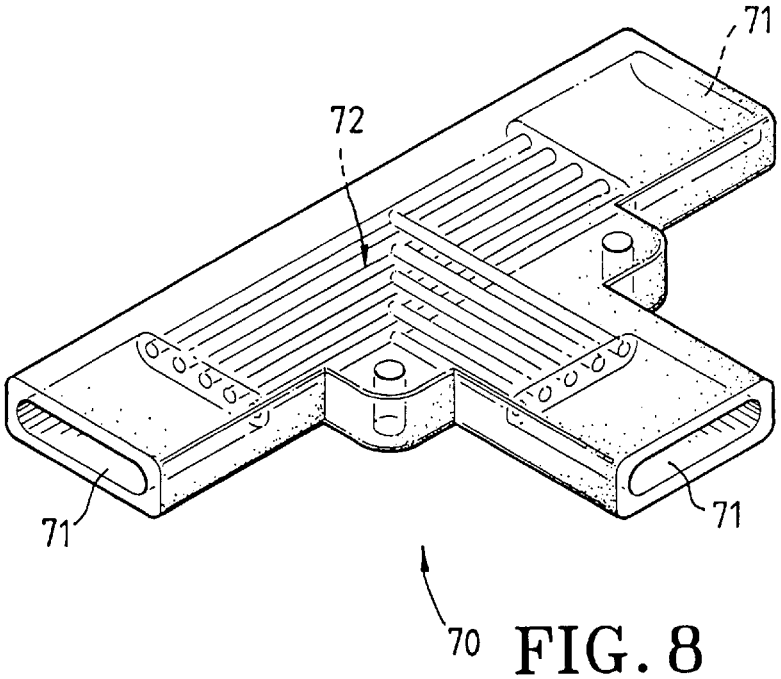
FIG. 8 is a perspective view showing a T shaped joint device in accordance with the present invention.
Figure 9:
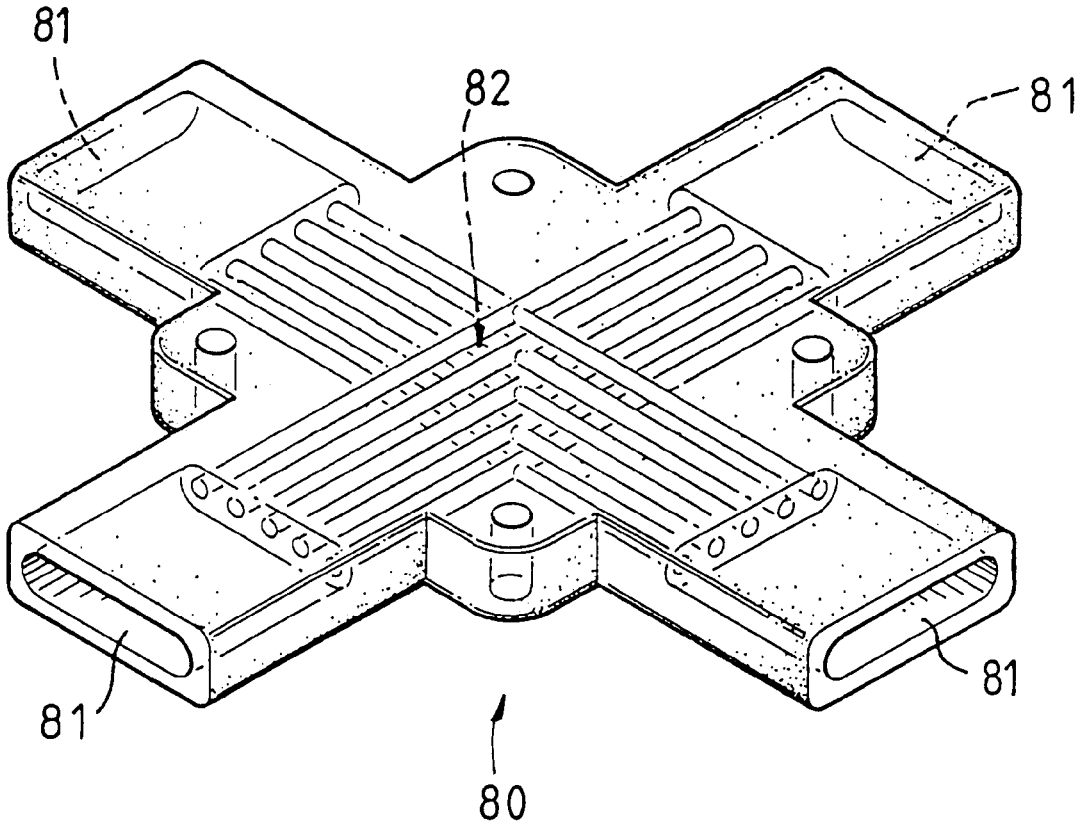
FIG. 9 is a perspective view showing a cross joint device in accordance with the present invention.
Figure 10:
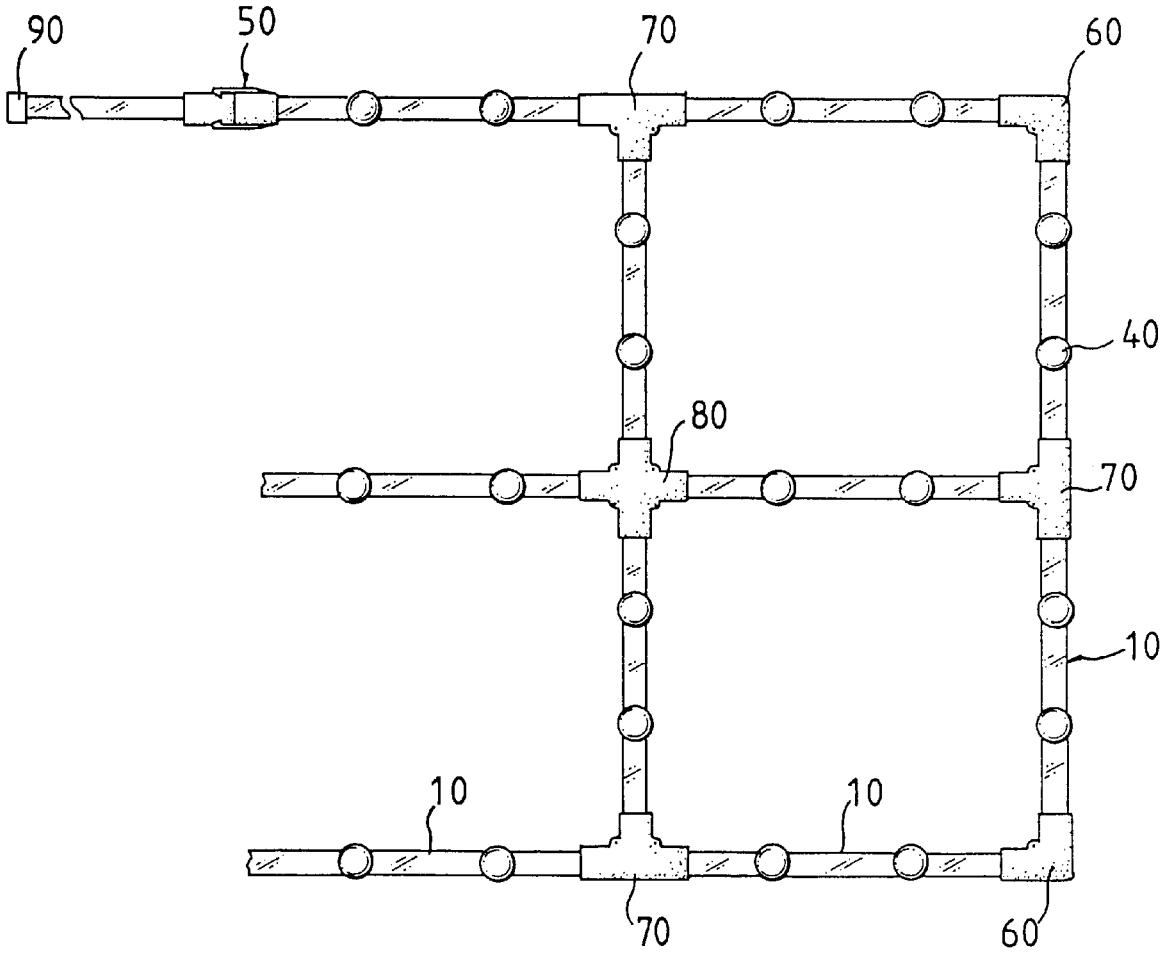
FIG. 10 is a schematic view showing an assembled condition of the various joint devices and the belt light in accordance with the present invention.

Referring to FIG. 10, to allow the belt light 10 in accordance with the present invention to vary based on the desired configuration and spatial limitation, the present invention further provides a design of joint device which may be an L shaped configuration 60 having two free ends (see FIG. 7), a T shaped configuration 70 having three free ends (see FIG. 8) or a cross configuration 80 having four free ends. No matter what the configuration of the joint device is, each of the free ends thereof comprises a receiving slot 61, 71 or 81 extending lengthwise. In the following, a description for only the L shaped joint device 60 (FIG. 7) will be given. The receiving slot 61 comprises five rigid pins pointing outward in the lengthwise direction to correspond to the five electric wires 32, wherein the rigid pins of the two receiving slots 61 are in electrical connection with each other. The best design of the L shaped joint device 61 is to provide a pin receiving device 62 therein which correspond to the electric wires 32 to be jointed together. (In the T shaped joint device 70, there is provided with the pin receiving devices 72 and in the cross joint device 80, there is provided with the pin receiving devices 82.) The first rigid pins 511 of the conductive pin device 51 as shown in FIG. 6*a* are then respectively inserted into the two ends of the pin receiving devices 62 and the two belt lights 10 to be connected are then inserted into the two receiving slots 61 to have the second rigid pins 513 penetrate into the electric wires 32 so as to complete the electrical connection between the two belt lights 10. The T shaped joint device 70 can be used to connect three belt lights 10 and the cross joint device 80 to connect four belt lights 10. The structure and operation for the electrical connections within the T shaped and cross joint devices 70 and 80 are substantially the same as the L shaped joint device 60 and no more description therefor will be given.

The above description is made with respect to the preferred embodiments of the present invention. It is possible for those skilled in the art to make a variety of modifications and changes without departing from the scope and spirit of the present invention. For example, the base 21 of the bulb holder 20 may be provided with a plurality of holes 29 for fixing the belt light 10 and the end of the electric belt 30 may be additionally provided with a cap 90. All these modifications and changes should be considered within the scope of the present invention as defined in the appended claims.

What is claimed is:

1. A structure of belt light comprising:

a plurality of bulb holders, each of the bulb holders made of a rigid insulation material and comprising a base and a cylindrical socket mounted on the base;

an electric belt, extending through the base of each of the bulb holders, the electric belt comprising a solid insulation enclosure and a plurality of electric wires which are parallel with each other and enclosed within the enclosure;

each said socket comprising a plurality of conductive selection holes formed on a bottom thereof, the conductive selection holes independently extending through the bottom of the respective said socket to the electric wires enclosed within the enclosure of the electric belt;

wherein the base of each of the bulb holders is integrally formed with the electric belt;

each of the sockets has a top circumference, and each of the bulb holders comprises a watertight rim which is made of a flexible insulation material and formed along the top circumference so that when a bulb is received within the socket, a lower side of glass portion of the bulb is in watertight contact with the watertight rim;

each of the bulb holders further comprises an outer jacket which extends from the watertight rim to surround the socket and which is made of a same material as the watertight rim; and the watertight rim, the outer jacket and the base of each of the bulb holders are formed integrally.

2. The structure of belt light as claimed in claim 1, wherein the outer jacket, the socket and the base of the bulb holder are formed integrally.

3. The structure of belt light as claimed in claim 1, wherein the base of each of the bulb holders is provided with a plurality of holes for fixing the belt light.

4. The structure of belt light as claimed in claim 1, further comprising an extension device mounted to an end of the belt light to electrically connect a next belt light based on the desired length.

5. The structure of belt light as claimed in claim 4, wherein the extension device comprises a conductive pin device and an insulation housing, the conductive pin device comprising a plurality of first rigid pins which have sharpened ends pointing rearward and correspond to the electric wires, and a plurality of second rigid pins which have sharpened ends pointing forward and are respectively in electric connection with the first rigid pins, the insulation housing comprising a first channel extending therethrough in a front to rear direction to receive the conductive pin device therein at a central section of the first channel, and wherein the extension device further comprises an adhesive medium disposed in the first channel after the ends of the belt lights are received in the first channel to correspondingly penetrate the first and second rigid pins into the electric wires of the belt.

6. The structure of belt light as claimed in claim 5, wherein the extension device further comprises a retainer having a front portion and a rear portion, two catches arranged on two opposite sides and extending forward, and a plurality of conductive terminals corresponding to the electric wires, the front portion being made of a solid insulation material, the rear portion comprising a second channel extending in a front to rear direction, each of the terminals comprising a pin receiving tube and a third rigid pin electrically connected to a rear side of the pin receiving tube with a sharpened end pointing rearward, the terminals extending from a front edge of the front portion into the second channel, the insulation housing having a groove formed on each of two opposite sides so that when the front portion of the retainer is inserted into the first channel and the plurality of first rigid pins are received into the pin receiving tubes, the two catches fasten in the grooves to form a releasable catching engagement.

7. The structure of belt light as claimed in claim 6, wherein the retainer comprises a connector and an insulation casing, the insulation housing comprising a third channel extending therethrough in a front to rear direction, the third channel having a front end with an end rim disposed thereon, the connector having a flange provided along a circumference at a central section of the connector, and the two catches respectively provided on two opposite sides of the insulation casing so that when the connector is inserted into the insulation casing through a rear side of the third channel, the flange of the connector abuts against the end rim of the third channel.

8. The structure of belt light as claimed in claim 1, further comprising a joint device mounted to an end of the belt light to electrically connect to a next belt light as desired.

9. The structure of belt light as claimed in claim 8, wherein the joint device comprises an L shaped configuration having two ends, each having a receiving slot extending lengthwise, each of the receiving slots having a plurality of rigid pins fixed therein and facing outward to correspond to the plurality of electric wires, the rigid pins of the two receiving slots being in electrical connection with each other, and wherein the joint device further comprises an adhesive medium disposed in the receiving slot of each of the ends thereof after the end of each of the belt lights is received in the slot to correspondingly penetrate the rigid pins into the electric wires of the belt.

10. The structure of belt light as claimed in claim 8, wherein the joint device comprises a T shaped configuration having three ends each having a receiving slot extending lengthwise, each of the receiving slots having a plurality of rigid pins fixed therein and facing outward to correspond to the plurality of electric wires, the rigid pins of the three receiving slots being in electrical connection with each other, and wherein the joint device further comprises an adhesive medium disposed in the receiving slot of each of the ends thereof after the end of each of the belt lights is received in the slot to correspondingly penetrate the rigid pins into the electric wires of the belt.

11. The structure of belt light as claimed in claim 8, wherein the joint device comprises a cross configuration having four ends each having a receiving slot extending lengthwise, each of the receiving slots having a plurality of rigid pins fixed therein and facing outward to correspond to the plurality of electric wires, the rigid pins of the four receiving slots being in electrical connection with each other, and wherein the joint device further comprises an adhesive medium disposed in the receiving slot of each of the ends thereof after the end of each of the belt lights is received in the slot to correspondingly penetrate the rigid pins into the electric wires of the belt.

12. An extension device of a belt light adapted to be mounted to an end of the belt light to electrically connect a next belt light in accordance with a desired length, wherein the belt light comprises an electric belt, the electric belt comprising a solid insulation enclosure and a plurality of electric wires parallel to each other and enclosed within the enclosure, the extension device comprising:

a conductive pin device, comprising a plurality of first rigid pins which have sharpened ends pointing rearward and correspond to the electric wires, and a plurality of second rigid pins which have sharpened ends pointing forward and respectively in electrical connection with the first rigid pins;

and insulation housing comprising a first channel extending therethrough in a front to rear direction to receive the conductive pin device therein at a central section of the first channel; and an adhesive medium disposed in the first channel after the ends of the belt light are received in the first channel to correspondingly penetrate the first and second rigid pins into the electric wires of the belt.

13. The extension device of belt light as claimed in claim 12, wherein the extension device further comprises a retainer having a front portion and a rear portion, two catches arranged on two opposite sides and extending forward and a plurality of conductive terminals corresponding to the electric wires, the front portion being made of a solid insulation material, the rear portion comprising a second channel extending in a front to rear direction, each of the plurality of terminals comprising a pin receiving tube and a third rigid pin electrically connected to rear side of the pin receiving tube with a sharpened end pointing rearward, the plurality of terminals extending from a front edge of the front portion into the second channel, the insulation housing having a groove formed on each of two opposite sides so that when the front portion of the retainer is inserted into the first channel and the plurality of first rigid pins are received into the pin receiving tubes, the two catches fasten in the grooves to form a releasable catching engagement.

14. The extension device of belt light as claimed in claim 13, wherein the retainer comprises a connector and an insulation casing, the insulation casing comprising a third channel extending therethrough in a front to rear direction, the third channel having a front end with an end rim provided thereon, the connector having a flange provided along a circumference at a central section of the connector and the two catches respectively provided on two opposite sides of the insulation housing so that when the connector is inserted into the insulation housing through a rear side of the third channel, the flange of the connector abuts against the end rim of the third channel.

* * * * *